US008430138B2

(12) United States Patent
McGeary

(10) Patent No.: US 8,430,138 B2
(45) Date of Patent: Apr. 30, 2013

(54) FUNNEL

(76) Inventor: John McGeary, County Tyrone (GB)

( * ) Notice: Subject to any disclaimer, the term of this patent is extended or adjusted under 35 U.S.C. 154(b) by 0 days.

(21) Appl. No.: 13/128,796

(22) PCT Filed: Nov. 13, 2009

(86) PCT No.: PCT/EP2009/008090

§ 371 (c)(1),
(2), (4) Date: May 11, 2011

(87) PCT Pub. No.: WO2010/054828

PCT Pub. Date: May 20, 2010

(65) Prior Publication Data

US 2011/0214782 A1 Sep. 8, 2011

(30) Foreign Application Priority Data

Nov. 15, 2008 (GB) ..... 0820950.4

(51) Int. Cl.
*B65B 39/00* (2006.01)
*B67C 11/04* (2006.01)

(52) U.S. Cl.
USPC ..... 141/340; 141/331; 141/333

(58) Field of Classification Search ..... 141/331–345
See application file for complete search history.

(56) References Cited

U.S. PATENT DOCUMENTS 1,692,039 A * 11/1928 Hinz ..... 141/333
2,127,788 A 8/1938 Schmutzler
2,620,957 A 12/1952 Taylor
2,629,377 A * 2/1953 Parks ..... 604/262
3,654,969 A * 4/1972 Vazquez et al. ..... 141/106
4,789,017 A * 12/1988 Panasewicz et al. ..... 141/342
4,802,514 A * 2/1989 Morse ..... 141/86
4,896,707 A 1/1990 Cowles
5,641,007 A * 6/1997 Falk ..... 141/106
5,803,140 A * 9/1998 Jodoin ..... 141/332
5,852,961 A 12/1998 Kotowski (Continued)

FOREIGN PATENT DOCUMENTS

| | | |
|---|---|---|
| AT | 349352 | 4/1979 |
| DE | 3819964 | 7/1989 |
| FR | 2625489 | 7/1989 |
| GB | 2081129 | 2/1982 |

OTHER PUBLICATIONS

International Search Report for PCT/EP2009/008090 mailed Feb. 19, 2010.

*Primary Examiner* — Timothy L Maust
(74) *Attorney, Agent, or Firm* — Warner Norcross & Judd LLP

(57) ABSTRACT

A funnel (1) comprising a funnel body (2) defining an upper inlet opening and a lower discharge opening, the inlet being of greater diameter or width than the discharge opening, at least a portion of the funnel body being define by or having mounted thereon an attachment means (16) permitting the funnel to be attached to a substantially vertically arranged body panel of a vehicle. In a preferred embodiment said attachment means comprises one or more regions or portions of a magnetic material (16) for attachment to steel body panels of the vehicule or other ferromagnetic objects. In an alternative embodiment said attachment means may comprise one more suction cups. Preferably at least a portion of the funnel body is formed from a flexible or callapsible material whereby the funnel can be manipulated between an in use configuration and a collapsed or folded configuration to enable the funnel to stored in a compact form.

20 Claims, 1 Drawing Sheet

U.S. PATENT DOCUMENTS 5,857,503 A * 1/1999 Vreeken ..... 141/332
5,967,203 A * 10/1999 Culver, III ..... 141/106
6,276,411 B1 8/2001 Veneziano
6,758,308 B1 * 7/2004 Hearting et al. ..... 184/105.1
7,246,639 B2 * 7/2007 Kuntz ..... 141/86
7,677,276 B2 * 3/2010 Sun ..... 141/332
2008/0041491 A1 2/2008 Salani et al.

* cited by examiner

FUNNEL

This invention relates to a funnel and in particular to a funnel for aiding the filling of a vehicle fuel tank from a portable container.

If, due to driver error or failure of a vehicle fuel gauge, a vehicle is accidentally allowed to run out of fuel, it is necessary to pour a volume of fuel into the filler neck of the vehicle fuel tank from a portable container to enable the vehicle to be driven to the nearest fuel station. If a purpose built fuel container having a specially designed long spout is available, such task is not too onerous because the spout can be inserted into the filler neck of the fuel tank of the vehicle. However, if such purpose built container and spout is not available, it can be very difficult, if not impossible, to pour fuel into the fuel tank due to the narrow opening of the filler neck of the fuel tank and the fact that such opening is normally provided on a side surface of the vehicle on a vertical or substantially vertically arranged body panel. In such circumstances, filling of the vehicle with fuel from a portable container can be assisted by the use of a suitably dimensioned funnel. However, even if a suitably sized funnel can be found to guide fuel into the filler neck of the fuel tank, it is very difficult for a lone person to hold the funnel while at the same time holding a portable fuel container and pouring fuel into the funnel from the container.

The present invention provides an improved funnel that overcomes the abovementioned problem.

According to the present invention there is provided a funnel comprising a funnel body defining an upper inlet opening and a lower discharge opening, the inlet being of greater diameter or width than the discharge opening, at least a portion of the funnel body being defined by or having mounted thereon an attachment means permitting the funnel to be attached to a substantially vertically arranged body panel of a vehicle.

In a preferred embodiment said attachment means comprises one or more magnets or regions or portions of a magnetic material for attachment to steel body panels of the vehicle or other ferromagnetic objects.

In an alternative embodiment said attachment means may comprise one more suction cups.

Preferably at least a portion of the funnel body is formed from a flexible or collapsible material whereby the funnel can be manipulated between an in use configuration and a collapsed or folded configuration to enable the funnel to stored in a compact form.

Preferably the funnel body comprises a substantially planar portion adapted, in use, to lie against a body panel of a vehicle, said attachment means being provided on or associated with said planar portion of the funnel body. Preferably an upper edge of said planar portion is connected to and/or forms a portion of said inlet opening and a lower edge of said planar portion is connected to and/or forms a portion of said discharge opening. Preferably the planar portion of the funnel body is formed from a flexible material to allow the funnel to conform to the shape of a vehicle body panel to which it is attached.

Preferably said attachment means is provided on or associated with said planar portion of the funnel body. At least a portion of said planar portion may be formed from or provided with a magnetic material defining said attachment means. In one embodiment said magnetic material may be in the form of a flexible sheet. The magnetic material may comprise rubber impregnated a ferrite material to provide the desired degree of flexibility. Alternatively a plurality of magnets may be mounted on the planar portion of the frame.

Preferably the inlet opening of the funnel body is provided with a reinforcement frame to support the inlet opening when the funnel is in its in use configuration. In a preferred embodiment said reinforcement frame comprises a first substantially planar portion defining one side of the inlet opening and a substantially arcuate second portion extending from the first portion to define a substantially semi-circular opening when the funnel is in its in use configuration. Preferably said second portion of the frame is pivotally connected to the first portion to permit the second portion to be moved with respect to the first portion between a raised or operative position, wherein the second portion extends substantially perpendicular to said planar portion of the funnel body when the funnel is in its in use configuration, and a lowered or folded position, wherein said second portion lies substantially parallel to said planar portion of the funnel body.

Said attachment means may be mounted on, attached to or integrally formed with said first portion of the reinforcement frame. In one embodiment a plurality of magnets, such as button magnets, are mounted on said first portion. Alternatively a plurality of suction cups may be mounted on or integrally formed with said first portion of the reinforcement frame.

Preferably the funnel includes an elongate discharge nozzle attached to or forming an extension of said discharge opening of the funnel body. In one embodiment said elongate discharge nozzle may be releasably attached to said discharge opening of the funnel body.

Preferably the discharge nozzle in angled to extend into a filler neck of a vehicle fuel tank when the funnel is attached to a side of the vehicle. Preferably the filler nozzle is formed from a flexible material. The filler nozzle may have a concertina construction to enable nozzle to be inserted into a filler opening.

An embodiment of the present invention will now be described by way of example only with reference to the accompanying drawings, in which.

Figure 1:
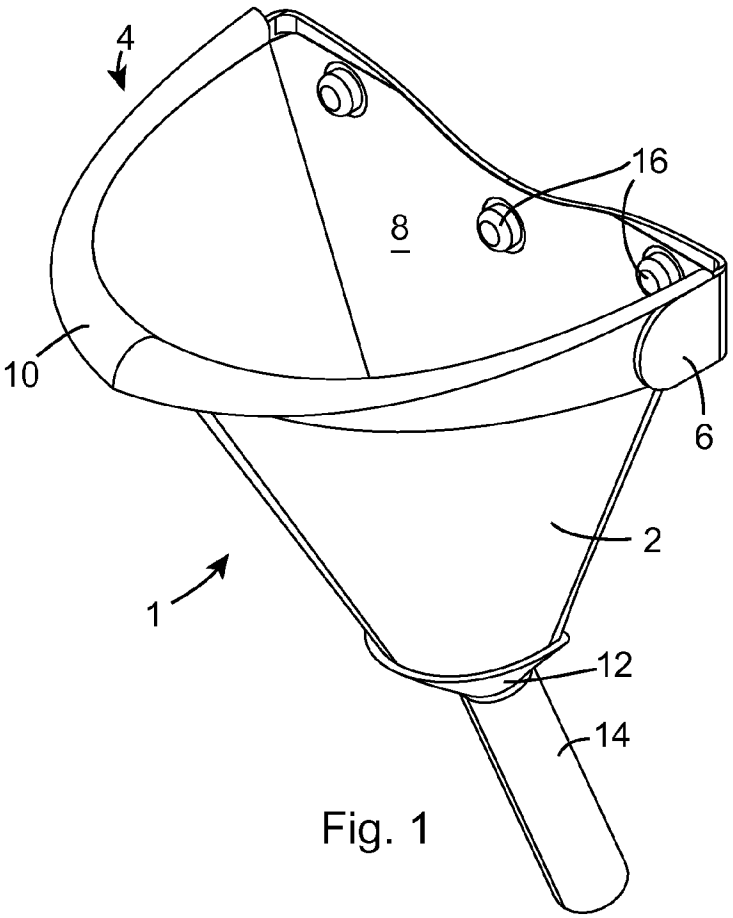
FIG. 1 is a perspective view of a funnel according to an embodiment of the present invention.
Figure 3:
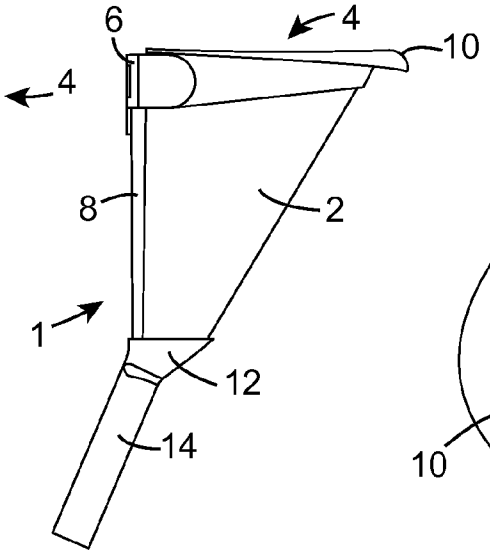
FIG. 3 is a side view of the funnel of FIG. 1.
Figure 2:
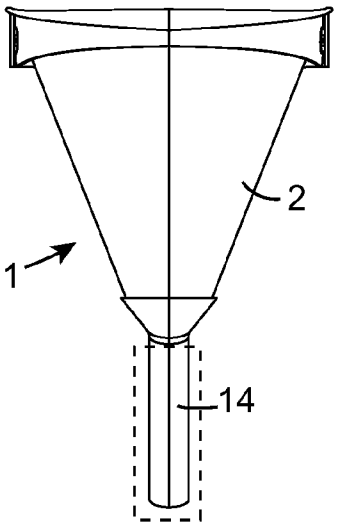
FIG. 2 is a front view of the funnel of FIG. 1.
Figure 4:
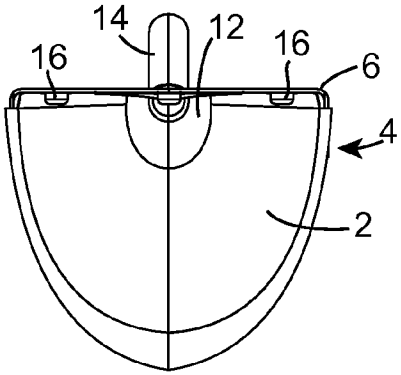
FIG. 4 is a plan view of the funnel of FIG. 1.

As shown in the drawings, a funnel 1 according to an embodiment of the present invention comprises a funnel body 2 formed from a flexible sheet material, such as a substantially tubular sheet of a suitable plastic material that is resistant to fuel, such funnel body 2 defining a tapered funnel having an upper inlet opening and a lower discharge opening, the inlet being of greater diameter or width than the discharge opening.

A reinforcement frame 4 is secured to an upper end of the funnel body 2 frame to support the inlet opening when the funnel is in its in use configuration. The reinforcement frame 4 comprises a substantially flat rear portion 6, defining an upper edge of a substantially planar rear 8 face of the funnel 1 arranged to lie against and conform to a surface to which the funnel 1 is to be attached, in particular a portion of a body panel of a vehicle, such as a car or van, and a substantially arcuate front portion 10, said front portion 10 extending from either end of the rear portion 6 to define a substantially semi-circular opening when the funnel 1 is in its in use configuration. The reinforcement frame 4 preferably comprises a plastic frame and may be thermally welded to adhesively secured to an upper region of the funnel body 2. Alternatively the reinforcement frame 4 may be formed from a metallic material.

The front portion 10 of the frame 4 is pivotally connected to either end of the rear portion 6 to permit the front portion 10 to be moved with respect to the rear portion 6 between a raised or operative position, as shown in the drawings, wherein the front frame portion 10 extends substantially perpendicular to the rear frame portion 6 when the funnel 1 is in its in use configuration, and a lowered or folded position, wherein said front frame portion 10 lies substantially parallel to said planar rear face 8 of the funnel body 2. The front frame portion 10 has a curved lip to provide greater rigidity to the inlet opening of the funnel 1.

A moulded plastic discharge nozzle 12 is releasably attached to said discharge opening of the funnel body 2 to define an outlet of the funnel. The lower end of the discharge nozzle 12 defines an elongate spout 14 which is angled to enable the spout 14 to extend into a filler neck of a vehicle fuel tank when the funnel 1 is attached to a side of the vehicle. The spout 14 may be detachable from an upper portion of the discharge nozzle 14. For example, the spout 14 may be provided with an internal thread to engage a threaded lower end of the discharge nozzle 12.

Three spaced apart button magnets 16 are mounted in suitable recesses formed in the rear portion 6 of the reinforcement frame 4 to allow the funnel 1 to be attached to a steel panel, such as a body panel of a vehicle. In an alternative embodiment a flexible sheet of magnetic material, such as a rubber sheet impregnated with a ferromagnetic material, may be attached to or integrally formed with the rear portion 6 of the frame 4 or over at least a portion of the rear face 8 of the funnel body 2 to define a magnetic attachment for attaching the funnel 1 to a steel body panel.

In an alternative embodiment a series of suction cups may be attached to or formed on a rear face of the rear portion 6 of the frame for attaching the funnel to a surface, such as a vehicle body panel above a fuel filter.

The flexibility of the funnel body 2 and the folding functionality of the reinforcement frame 4 allow the funnel to be folded to a compact size for compact storage when not in use. This allows the funnel 1 to be tucked into a storage compartment within a vehicle, for example in a recess within a spare wheel well, such as typically provided for holding emergency tools, for example for use in changing a wheel. This allows the funnel 1 to be readily stored within the vehicle for emergency use when required.

When it is desired to use the funnel 1 to assist filling of a fuel tank from a portable container, the funnel 1 can be unfolded and front portion 10 of the frame 4 can be pivoted to its raised position to hold open the inlet opening of the funnel 1. The spout 14 of the discharge nozzle 12 can be inserted into the filler neck of the vehicle fuel tank through the filler opening and the flat rear face 8 of the funnel body 2 can be placed against the side of the vehicle above the filler opening. The funnel 1 can then be retained in place against the side of the vehicle by the magnetic attraction of the magnets against the steel body panel of the vehicle (or by the suction of the suction cups against the panel where the attachment means comprises suction cups in place of magnets), leaving both hands of the vehicle owner free to pour the contents of a portable container into the vehicle fuel tank via the funnel 1.

The invention is not limited to the embodiment(s) described herein but can be amended or modified without departing from the scope of the present invention.

The invention claimed is:

1. A funnel comprising a funnel body defining an upper inlet opening and a lower discharge opening, the inlet being of greater diameter or width than the discharge opening, at least a portion of the funnel body being defined by or having mounted thereon an attachment means permitting the funnel to be attached to a substantially vertically arranged body panel of a vehicle, the funnel body comprising a substantially planar portion adapted, in use, to lie against a body panel of a vehicle, said attachment means being provided on or associated with said planar portion of the funnel body, wherein the planar portion of the funnel body is formed from a flexible material to allow the funnel to conform to the shape of a vehicle body panel to which it is attached, and wherein an upper edge of said planar portion is connected to and/or forms a portion of said inlet opening and a lower edge of said planar portion is connected to and/or forms a portion of said discharge opening.

2. A funnel as claimed in claim 1, wherein said attachment means comprises one or more magnets or regions or portions of a magnetic material for attachment to steel body panels of the vehicle or other ferromagnetic objects.

3. A funnel as claimed in claim 1, wherein said attachment means comprise one or more suction cups.

4. A funnel as claimed in claim 1, wherein at least a portion of the funnel body is formed from a flexible or collapsible material whereby the funnel can be manipulated between an in use configuration and a collapsed or folded configuration to enable the funnel to be stored in a compact form.

5. A funnel as claimed in claim 1, wherein said attachment means is provided on or associated with said planar portion of the funnel body.

6. A funnel as claimed in claim 5, wherein at least a portion of said planar portion is formed from or provided with a magnetic material defining said attachment means.

7. A funnel as claimed in claim 6, wherein said magnetic material may be in the form of a flexible sheet.

8. A funnel as claimed in claim 7, wherein the magnetic material comprises rubber impregnated a ferrite material to provide the desired degree of flexibility.

9. A funnel as claimed in claim 6 wherein a plurality of magnets are mounted on said planar portion of the frame.

10. A funnel as claimed in claim 1, wherein the inlet opening of the funnel body is provided with a reinforcement frame to support the inlet opening when the funnel is in its in use configuration.

11. A funnel as claimed in claim 10, wherein said reinforcement frame comprises a substantially planar first portion, said first portion defining one side of the inlet opening adjacent said planar portion of the funnel body, and a substantially arcuate second portion, said second portion extending from the first portion to define a substantially semi-circular opening when the funnel is in its in use configuration.

12. A funnel as claimed in claim 11, wherein said second portion of the frame is pivotally connected to the first portion to permit the second portion to be moved with respect to the first portion between a raised or operative position, wherein the second portion extends substantially perpendicular to said first portion when the funnel is in its in use configuration, and a lowered or folded position, wherein said second portion lies substantially parallel to said planar portion of the funnel body.

13. A funnel as claimed in claim 11, wherein said attachment means is mounted on, attached to or integrally formed with said first portion of the reinforcement frame.

14. A funnel as claimed in claim 13, wherein a plurality of magnets are mounted on said first portion to define said attachment means.

15. A funnel as claimed in claim 13, wherein a plurality of suction cups are mounted on or integrally formed with said first portion of the reinforcement frame to define said attachment means.

16. A funnel as claimed in claim 1, further comprising an elongate discharge nozzle attached to or forming an extension of said discharge opening of the funnel body.

17. A funnel as claimed in claim 16, wherein said elongate discharge nozzle is releasably attached to said discharge opening of the funnel body.

18. A funnel as claimed in claim 16, wherein the discharge nozzle is angled to extend into a filler neck of a vehicle fuel tank when the funnel is attached to a side of the vehicle.

19. A funnel as claimed in claim 16, wherein the filler nozzle is formed from a flexible material.

20. A funnel as claimed in claim 19, wherein the filler nozzle comprises a construction configured to enable the nozzle to be inserted into a filler opening.

* * * * *